US007530512B2

(12) United States Patent
Dallimore et al.

(10) Patent No.: US 7,530,512 B2
(45) Date of Patent: May 12, 2009

(54) ROTOR FOR A CRUSHER

(75) Inventors: Rowan Dallimore, Radstock (GB); George Fensome, Bristol (GB)

(73) Assignee: Sandvik Intellectual Property AB, Sandviken (SE)

( * ) Notice: Subject to any disclaimer, the term of this patent is extended or adjusted under 35 U.S.C. 154(b) by 614 days.

(21) Appl. No.: 10/525,967

(22) PCT Filed: Aug. 27, 2003

(86) PCT No.: PCT/SE03/01321

§ 371 (c)(1),
(2), (4) Date: Jul. 29, 2005

(87) PCT Pub. No.: WO2004/020104

PCT Pub. Date: Mar. 11, 2004

(65) Prior Publication Data

US 2006/0163400 A1 Jul. 27, 2006

(30) Foreign Application Priority Data

Aug. 28, 2002 (SE) ..... 0202536

(51) Int. Cl.
*B02C 7/00* (2006.01)
*B02C 7/12* (2006.01)
*B02C 17/20* (2006.01)
*B02C 19/00* (2006.01)

(52) U.S. Cl. ..... 241/274; 241/275

(58) Field of Classification Search ..... 241/274, 241/275

See application file for complete search history.

(56) References Cited

U.S. PATENT DOCUMENTS

| | | | | |
|---|---|---|---|---|
| 3,154,259 | A | 10/1964 | Behnke et al. | |
| 3,970,257 | A | 7/1976 | MacDonald et al. | |
| 4,834,298 | A | 5/1989 | Murata et al. | |
| 5,911,370 | A * | 6/1999 | Lusty | 241/27 |
| 6,227,472 | B1 * | 5/2001 | Ryan et al. | 241/275 |
| 6,554,215 | B1 * | 4/2003 | Schultz et al. | 241/275 |

OTHER PUBLICATIONS

International Search Report dated Nov. 6, 2003.
International-Type Search Report for National Appl. No. SE 0202536-9 dated Mar. 18, 2003.

* cited by examiner

*Primary Examiner*—Bena Miller
(74) *Attorney, Agent, or Firm*—Drinker Biddle & Reath LLP

(57) ABSTRACT

A rotor for a vertical shaft impact crusher includes a vertical wall segment having a first wall portion which is tangential to the rotor and is located adjacent to the periphery of the rotor, and a second wall portion, which is angled in relation to the first wall portion and extends from the first wall portion into the rotor. The second wall portion includes a first section, which extends from the interior of the rotor towards its periphery and forms and obtuse first angle with the first wall portion, and a second section, which connects the first section and the first wall portion. The second section and the first wall portion form a second angle, which is smaller than the first angle, and at least one pocket for retaining material.

12 Claims, 6 Drawing Sheets

ROTOR FOR A CRUSHER

TECHNICAL FIELD OF THE INVENTION

The present invention relates to a rotor for a vertical shaft impact crusher, said rotor comprising a horizontal upper disc and a horizontal lower disc, said discs being separated by at least two vertical wall segments defining between them an outflow opening for material leaving the rotor, said wall segments each having a first wall portion being substantially tangential in relation to the rotor and being located adjacent to the periphery of the rotor and a second wall portion being angled in relation to said first wall portion and extending from the first wall portion into the rotor.

BACKGROUND ART

Vertical shaft impact crushers (VSI-crushers) are used in many applications for crushing hard material like rocks, ore etc. U.S. Pat. No. 3,154,259 describes a VSI-crusher comprising a housing and a horizontal rotor located inside the housing. Material that is to be crushed is fed into the rotor via an opening in the top thereof. With the aid of centrifugal force the rotating rotor ejects the material against the wall of the housing. On impact with the wall the material is crushed to a desired size. The housing wall could be provided with anvils or have a bed of retained material against which the accelerated material is crushed.

The rotor of a VSI-crusher usually has a horizontal upper disc and a horizontal lower disc. The upper and lower discs are connected with a vertical rotor wall. The upper disc has an aperture for feeding material into the rotor. The material lands on the lower disc and is then thrown out of the rotor via openings in the rotor wall. The vertical rotor walls are provided with wear tips of a hard material, such as a hard metal or a ceramic, to protect them from wear caused by the material leaving the rotor at a high speed. The wear tips are usually made from a hard material to resist wear. The hard material is however sensitive to impact by large objects, such as stones. Thus rotors are usually provided with means for building a bed of retained material against the vertical rotor wall. The bed of material is intended to protect the vertical wall from wear and to protect the wear tip from impact of large objects.

U.S. Pat. No. 3,970,257 to MacDonald describes a vertical shaft impact crusher having a rotor. The rotor is provided with outflow openings. Each outflow opening is provided with a tip which is held by a replaceable tip plate. The tip plate is mounted on a first segment of a vertical plate, said first segment being substantially tangential to the rotor and located at its periphery. A second segment of the vertical plate is welded to the first segment and extends, with an angle of about 120° to the first segment, from the periphery of the rotor towards a point located at a distance from the centre of the rotor. A build up of material along the vertical plate will protect the vertical plate from wear during operation. It has been found, however, that the build up of material at the vertical plate is not always stable and that the build up in many applications may be eliminated during crusher operation. The result is that the vertical plate, the tip plate and the tip is exposed to wear and impact by the feed material.

SUMMARY OF THE INVENTION

It is an object of the present invention to provide a rotor which eliminates or reduces the above mentioned drawbacks of the prior art and provides an increased rotor life and a reduced maintenance requirement.

This object is achieved with a rotor according to the preamble and characterised in that said second wall portion comprises a straight first section extending from the interior of the rotor towards the periphery of the rotor, said first section forming an obtuse first angle with said first wall portion, and a second section connecting the first section and the first wall portion, said second section and said first wall portion forming a second angle being smaller than said first angle, said second section and said first wall portion forming at least one pocket for retaining material.

The rotor of the present invention thus provides for retaining a stable bed of material inside the rotor. The bed is also sufficiently thick to protect the wall segment and in particular a tip holder holding a wear tip adjacent to the outflow opening from impact damages and to avoid wear on the wall segment and the tip holder. The invention has particular advantages when crushing very dry material or very wet material. With prior art rotors it has been very difficult to obtain a stable bed with such materials due to the inability of the prior art rotors to hold a sufficient depth of "locked" stones at the wall segment. The rotor according the invention makes it possible to obtain a very stable bed of material with any feed material, also with very dry and very wet materials. The stable bed reduces the wear on the wall segment. The thick and stable bed also reduces the risk that large objects fed to the rotor would impact and destroy the wear tip that is used to protect a free edge of the first wall portion. The pocket makes it possible to retain also larger objects which further improve the stability of the bed of material. Due to the decreased risk of wear the first wall portion and a holding plate of the tip holder can be made thinner. Thus the wear tip may be located closer to the periphery of the rotor resulting in an ejection of material via the outflow opening at a higher speed, which improves the crushing performance due to increased impact energy. The higher speed of the ejected material and the fact that the wear tip is located closer to the periphery of the rotor decreases the risk that ejected material may slide along the periphery of the rotor and cause wear to the exterior of the rotor.

Preferably said first angle is 110-155°. With a first angle of 110-155° the first section of the second wall portion will provide for building a stable and suitably thick bed of material providing a suitable path of the material ejected from the rotor. At a first angle larger than 155° (still keeping the first wall portion tangential in relation to the rotor) the bed would become unnecessarily heavy, which would make the rotor heavier and increase the risk of imbalance problems during operation. Also the first section would be located rather near the periphery of the rotor thereby increasing the risk that dust loaded air circulating inside the crusher may wear the outer part of the second wall portion. At a first angle smaller than 110° (still keeping the first wall portion tangential in relation to the rotor) the bed of material would not obtain a sufficient thickness to protect the wall segment from wear.

Preferably said second angle is 75-100°. A second angle of 75-100° has proven to provide a pocket suitable for retaining material and thus for providing a thick and stable bed of material built up against the wall segment. At a second angle smaller than 75° larger pieces of material are not well retained in the pocket, thus the stability of the bed is decreased. At a second angle larger than 100° the material in the pocket is not well secured. Thus there is a risk that the material in the pocket may slide out of the pocket and out of the rotor followed by a break down of the entire bed of material. It has proven particularly suitable with a second angle of 86-94°. An angle in said interval has proven to both allow large objects to be retained in the pocket and to secure them firmly in the pocket with little risk of a break down of the bed. Preferably the second angle is 90°.

Preferably the horizontal length of the second section is less than a tip distance being the shortest distance between the second section and a trailing edge of a wear tip located adjacent to a free vertical edge of the first wall portion. An advantage with this embodiment is that there is no or little risk that the bed of material is divided into two sub-beds with a part of the second wall portion being exposed to wear. With a too long second section the bend formed between the first section and the second section may extend out of the bed of material and into the flow of material ejected by the rotor. Such exposure would lead to rapid wear of the second wall portion, particularly at said bend. More preferably said horizontal length is 20-70% of the tip distance. A horizontal length of the second section smaller than 20% of the tip distance makes it difficult for the pocket to retain larger objects. Thus the bed of material becomes less stable. A horizontal length of the second section larger than 70% of the tip distance increases the risk that the bed is divided into two sub-beds making it less stable. Also the bend between the first section and the second section may extend out of the bed and may thus be subjected to wear.

According to another preferred embodiment a second pocket for retaining material is formed between said first section and said second section. The second pocket increases the stability of the bed and decreases the risk that the bed may break down.

Preferably the wall segment is adapted for building a bed of material extending continuously from the first wall portion to a rear support plate mounted at the first section of the second wall portion. A continuous bed of material provides the best protection against wear and the lowest risk of imbalance in the rotor during operation. A continuous bed is robust to different material types, material sizes and material amounts fed to the rotor since the material profile of the entire bed changes according to the prevailing operating conditions.

These and other aspects of the invention will be apparent from and elucidated with reference to the embodiments described hereafter.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
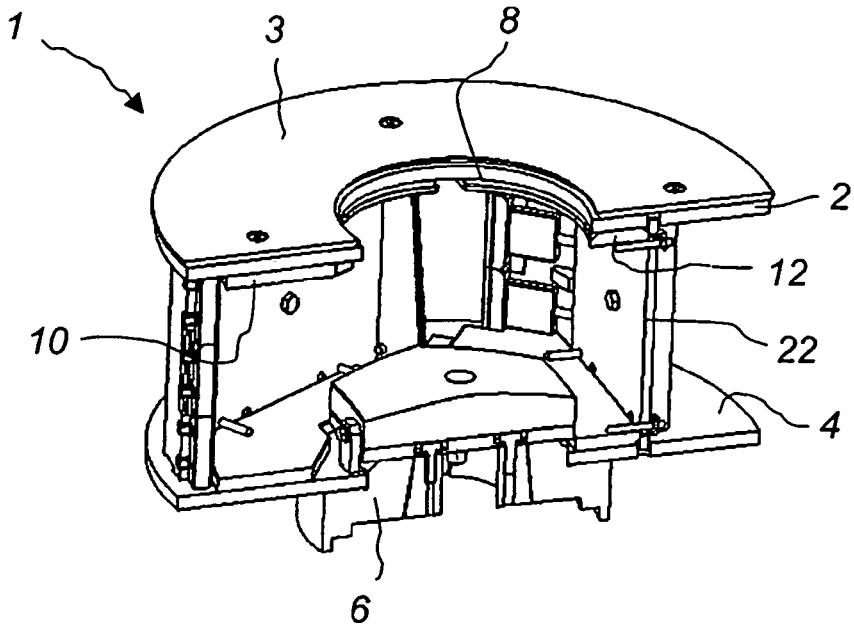
FIG. 1 is three-dimensional section view and shows a rotor for a VSI-crusher

FIG. 1 shows a rotor 1 for use in a VSI-crusher. The rotor 1 has a roof in the form of an upper disc 2 having a top wear plate 3 and a floor in the form of a lower disc 4. The lower disc 4 has a hub 6, which is welded to the disc 4. The hub 6 is to be connected to a shaft (not shown) for rotating the rotor 1 inside the housing of a VSI-crusher.

Figure 2:
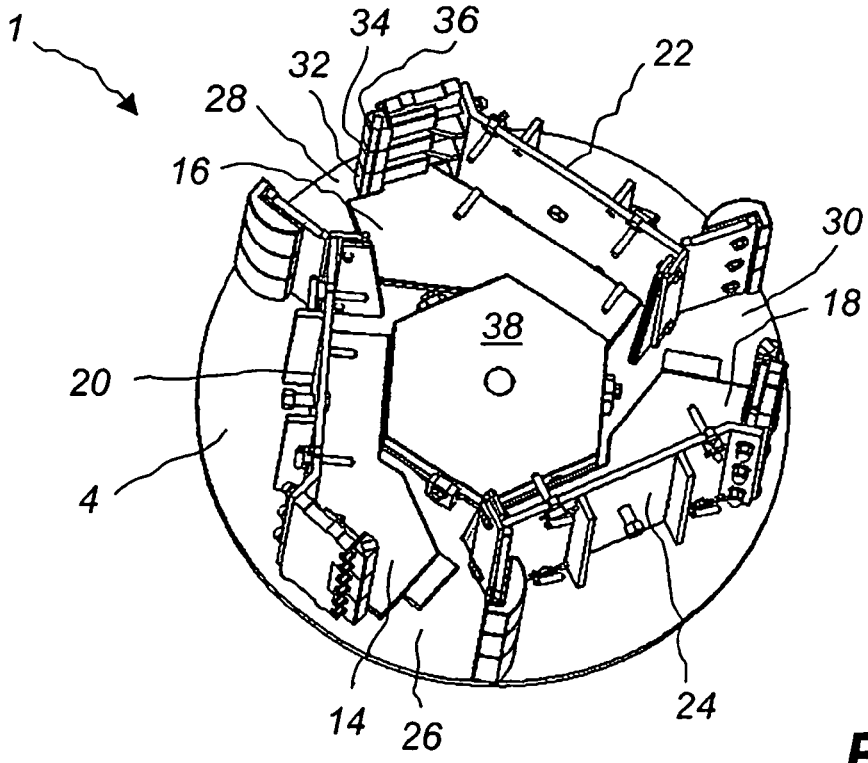
FIG. 2 is a three-dimensional view and shows the rotor of FIG. 1 with the upper disc removed.

The upper disc 2 has a central opening 8 through which material to be crushed can be fed into the rotor 1. The upper disc 2 is protected from wear by upper wear plates 10 and 12. The upper disc 2 is protected from rocks impacting the rotor 1 from above by the top wear plate 3. As is better shown in FIG. 2 the lower disc 4 is protected from wear by three lower wear plates 14, 16 and 18.

The upper and lower discs 2, 4 are separated by and held together by a vertical rotor wall which is separated into three wall segments 20, 22 and 24. The gaps between the wall segments 20, 22, 24 define outflow openings 26, 28, 30 through which material may be ejected against a housing wall.

At each outflow opening 26, 28, 30 the respective wall segment 20, 22, 24 is protected from wear by three wear tips 32, 34, 36 located at the trailing edge of the respective wall segment 20, 22, 24.

A distributor plate 38 is fastened to the centre of the lower disc 4. The distributor plate 38 distributes the material that is fed via the opening 8 in the upper disc 2 and protects the lower disc 4 from wear and impact damages caused by the material fed via the opening 8.

Figure 3:
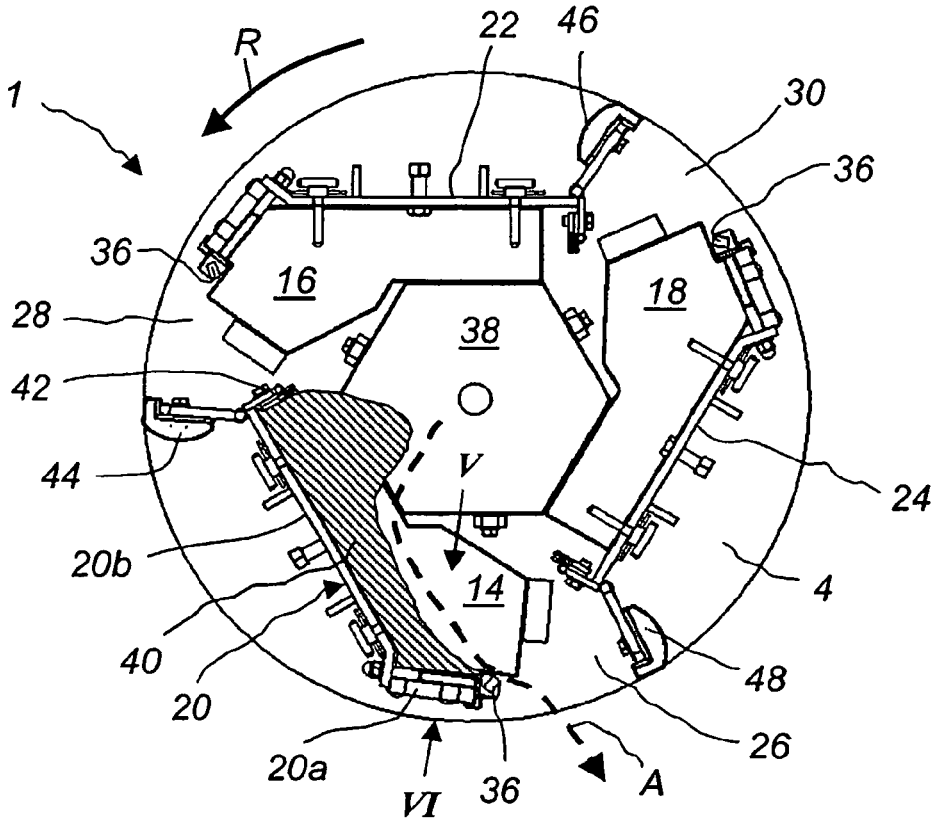
FIG. 3 shows the view of FIG. 2 as seen from above in a two dimensional perspective.

During operation of the rotor 1 a bed 40 of material is built up inside the rotor 1 against each of the three wall segments 20, 22, 24. In FIG. 3 only the bed 40 located adjacent to the wall segment 20 is shown. The bed 40, which consists of material that has been fed to the rotor 1 and then has been trapped inside it, extends from a rear support plate 42 to the wear tips 32, 34, 36. The bed 40 protects the wall segment 20 and the wear tips 32, 34, 36 from wear and provides a proper direction to the ejected material. The dashed arrow A describes a typical passage of a piece of rock fed to the rotor 1 via the central opening 8 and ejected via the outflow opening 26. The arrow R indicates the rotational direction of the rotor 1 during operation of the VSI-crusher.

Each wall segment 20, 22, 24 is provided with a cavity wear plate 44, 46, 48, each preferably having three cavity wear plate portions. The cavity wear plates 44, 46, 48 protect the rotor 1 and in particular the wear tips 32, 34, 36 from material rebounding from the housing wall and from ejected material and airborne fine dust spinning around the rotor 1.

Figure 4:
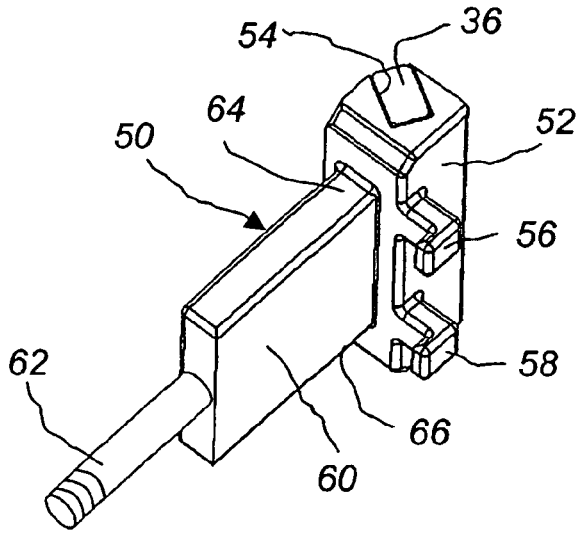
FIG. 4 is a three-dimensional view of a wear tip and tip holder.

In FIG. 4 a first embodiment of a tip holder 50 is shown. The tip holder 50 has a holding part 52 shaped as a rectangular parallelepiped. The holding part 52 has a longitudinal recess 54 in which the wear tip 36 is located. The wear tip 36 may be welded or glued to the holding part 52. The holding part 52 has two hooks 56, 58. The two hooks 56, 58 are located at the opposite face of the holding part 52 in relation to the recess 54. A holding plate 60 is attached to the holding part 52. The holding plate 60, which is a flat rectangular plate, is attached to the holding part 52 at a position between the hooks 56, 58 and the recess 54. At an end of the plate 60, said end being remote from the holding part 52, a round, threaded bar 62 is attached. The bar 62 is located in generally the same plane as the holding plate 60 and is perpendicular to the wear tip 36.

As can be seen in FIG. 4 the holding plate 60 has a smaller vertical extension than the holding part 52. Thereby an upper shoulder 64 and a lower shoulder 66 are formed at the respective transitions between the plate 60 and the part 52.

Figure 5:
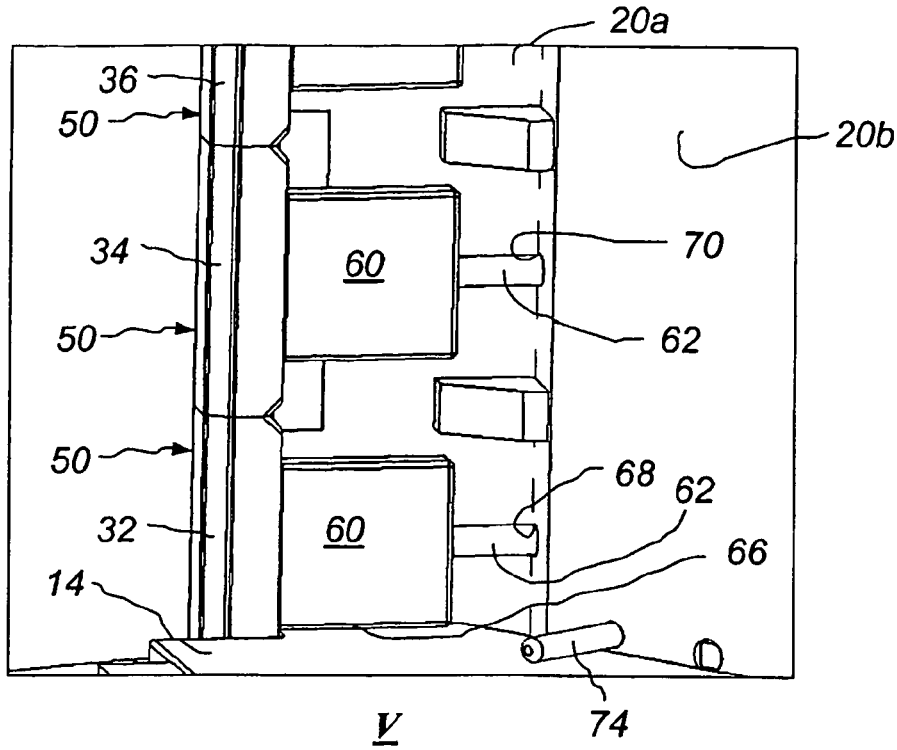
FIG. 5 shows a part of a wall segment as seen from the inside, i.e. in the direction of arrow V in FIG. 3, of the rotor.

In FIG. 5 a part of the wall segment 20 as seen from the inside, i.e. in the direction of the arrow V in FIG. 3, is shown. The wall segment 20 comprises a first wall portion 20*a* which is substantially tangential to the disc 4 and thus the rotor 1. A second wall portion 20*b* is fixed to the first wall portion 20*a*. The three wear tips, 32, 34, 36, each held by a tip holder 50, are attached to the wall 20 in such a way that the wear tips 32, 34, 36 form a continuous, vertical row of wear tips. The second wall portion 20*b* is provided with holes 68, 70, 72 through which the round bar 62 of the respective tip holder 50 extends.

As can be seen in FIG. 5 the lower wear plate 14 is inserted under the lower shoulder 66 of the tip holder 50 holding the lower tip 32. This shoulder 66 thus assists in holding the wear plate 14 in place under the shoulder 66. The upper shoulder 64 (not shown in FIG. 5) of the tip holder 50 holding the upper wear tip 36 in place holds an upper wear plate in place in a similar manner. A retractable pin 74 extending through the wall 20 further assists in holding the wear plate 14 in its proper position. Since the three tip holders 50 shown in FIG. 5 are identical they can replace each other. After some time of operation, usually causing most wear at the centre wear tip 34, the tip holders 50 may be taken out and then put back again at new positions to enable more hours of operation before the tips 32, 34, 36 are worn out.

Figure 6:
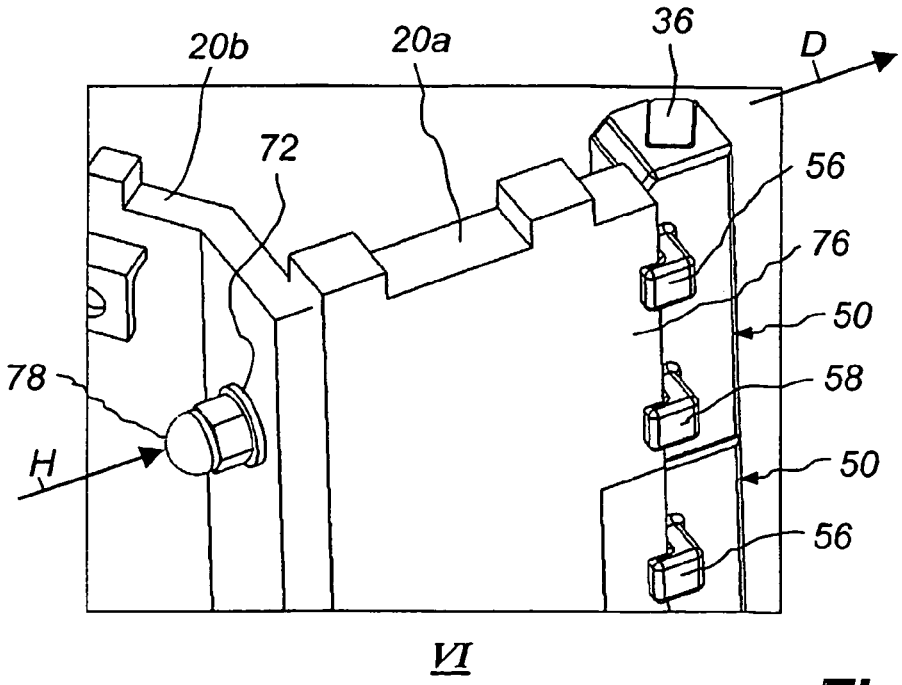
FIG. 6 shows a part of a wall segment as seen from the outside of the rotor, i.e. in the direction of arrow VI in FIG. 3.

FIG. 6 shows a part of the rotor as seen from the outside, i.e. in the direction of the arrow VI in FIG. 3. As can be seen the hooks 56, 58 of each tip holder 50 grips around the free vertical edge 76 of the first wall portion 20*a*. The threaded bar 62 of each tip holder 50 extends out of a hole 68, 70, 72 (of which only the hole 72 is indicated in FIG. 6) and is fixed towards the second wall portion 20*b* by a nut 78.

When mounting a tip holder 50 of the type described above the tip holder 50 is first allowed to slide along the first wall portion 20*a*. Thus the plate 60 and the threaded bar 62 are guided in a direction parallel to the first wall portion 20*a* until the hooks 56, 58 engage the free edge 76 and in such a way that the bar 62 passes through the hole 72. The nut 78 is screwed onto the part of the bar 62 extending on the outside of the second wall portion 20*b*. The nut 78 is a domed nut and thus protects the end portion of the threaded bar 62 from wear and from being hit by rocks. The risk that the end portion of the threaded bar 62 would be damaged such that dismounting the nut 78 becomes difficult is thus minimized. The nut 78 is tightened such that a certain, desired tension is obtained in the parts of the tip holder 50 that are located between the nut 78 and the hooks 56, 58. The nut 78 being located on the second wall portion 20*b* is protected by the first wall portion 20*a* from abrasive particles that often swirl around the rotor 1. Thus there is a limited risk that the nut 78 is worn down during operation of the crusher.

When a worn tip holder 50 is to be replaced a bed of material 40 has built up against the inside of the wall segment 20. The worn tip holder 50 may be released according to the following method. Firstly the nut 78 is unscrewed a few turns such that it is not tightly fixed to the bar 62. A hammer or similar tool is used to imply a force or a strike on the nut 78 and thus to the end part of the threaded bar 62 in the direction shown with an arrow H in FIG. 6. The nut 78 thus serve as a surface for implying the force or strike. The force or strike makes the tip holder 50, and in particular the threaded bar 62 and the plate 60, release from the often well compacted material bed 40. The nut 78 is then removed from the bar 62 such that the tip holder 50 may be taken away by guiding it away from the second wall portion 20*b* in a direction, which is indicted by an arrow D in FIG. 6, being substantially parallel to the first wall portion 20*a*. Thus a time consuming process of removing the bed 40 before dismounting the tip holder 50 may be avoided.

Figure 7:
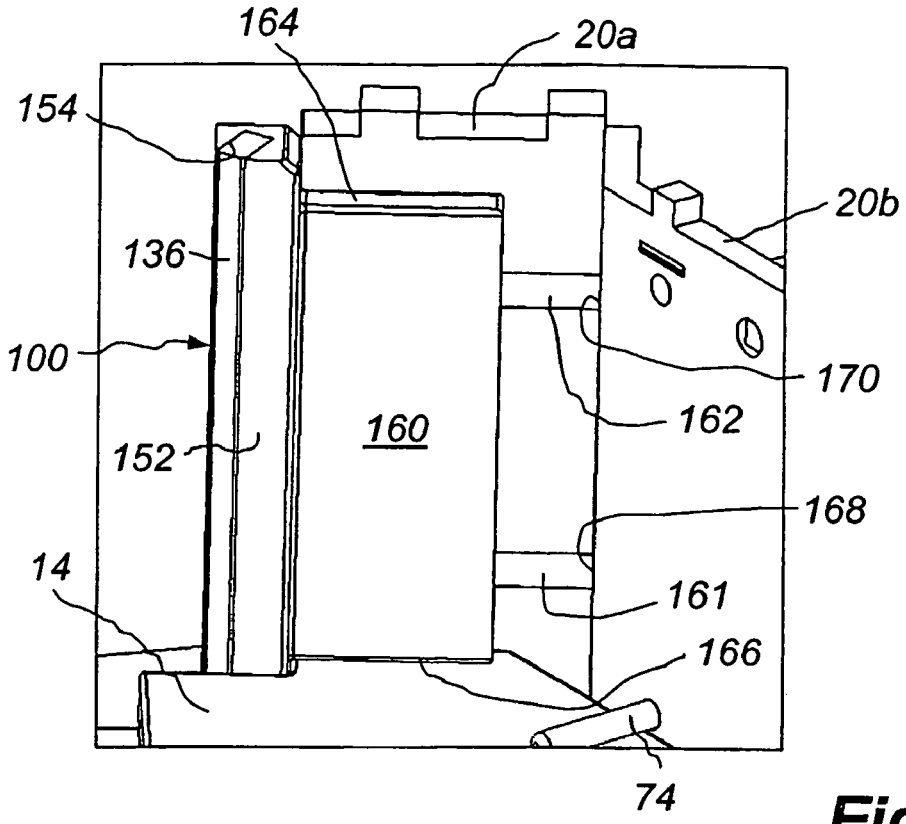
FIG. 7 shows a another embodiment of a tip holder.

In FIG. 7 another tip holder 100 is shown as seen from the inside of a rotor 1. The main differences compared to the tip holder 50 shown in FIG. 4 is that the tip holder 100 has a wide holding plate 160 and two threaded bars 161 and 162. The threaded bars 161, 162 extend through holes 168, 170 respectively, in the second wall portion 20*b*. The tip holder 100 has an upper shoulder 164 and a lower shoulder 166 for abutting against an upper wear plate (not shown) and a lower wear plate 14 respectively. A wear tip 136 located in a recess 154 of a holding part 152 extends over the whole vertical distance of the outflow opening. The tip holder 100 is mainly used for rotors 1 of smaller vertical extension and for rotors 1 were the mutual exchangeability of the tip holders 50 described above is not desired.

Figure 8:
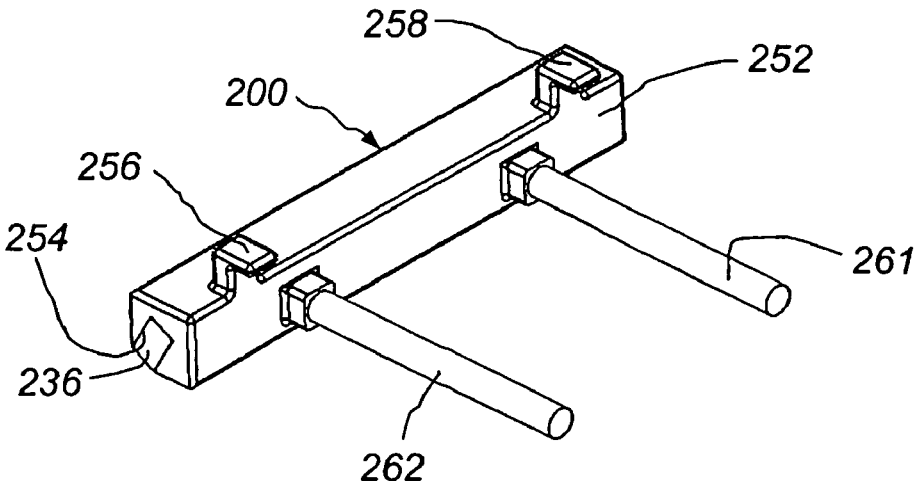
FIG. 8 is a three-dimensional view of still another embodiment of a tip holder.

In FIG. 8 yet another tip holder 200 is shown. The main differences between the tip holder 200 and the tip holder 50 shown in FIG. 4 is that the tip holder 200 has no holding plate and that threaded bars 261, 262 are attached directly to a holding part 252. The open space formed between the bars 261, 262 forms a material space. When such a tip holder 200 is attached to a rotor 1 the amount of material and the size of material that may be trapped in the bed 40 just behind the holding part 252 is increased. A wear tip 236 is fixed in a recess 254 of the holding part 252. The holding part 252 has two hooks 256, 258 for securing it to the vertical free edge 76 of the first wall portion 20*a*. The bars 261, 262 may have the additional function of acting as shoulders for holding horizontal wear plates in the correct position.

Figure 9:
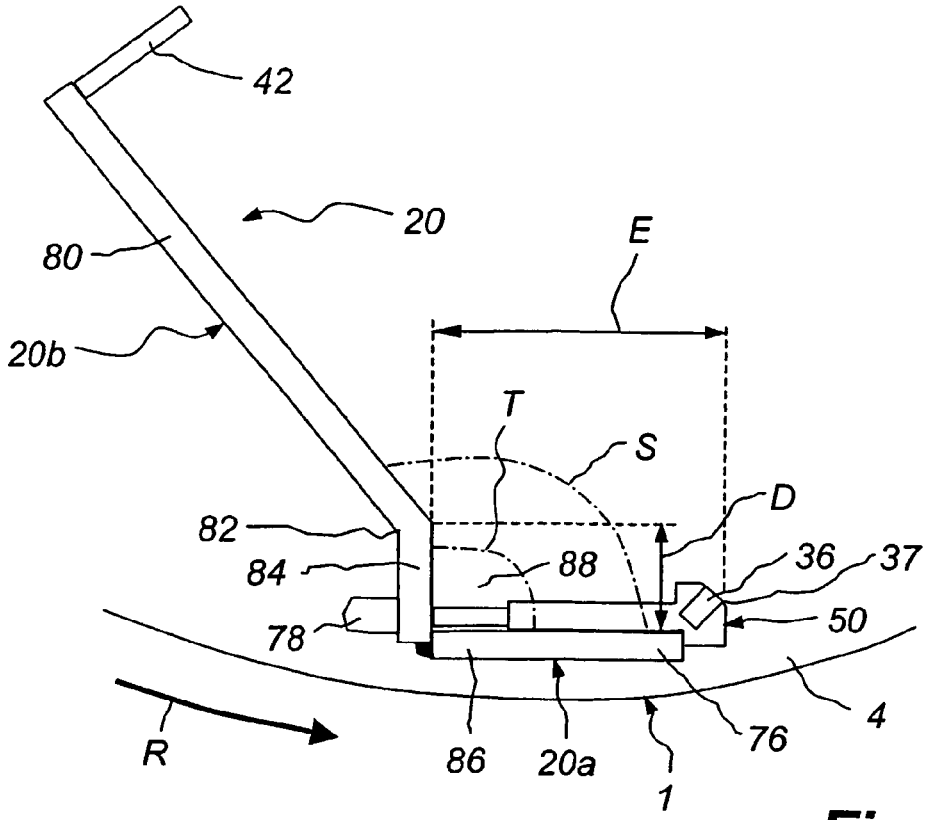
FIG. 9 is an enlarged top view and shows a wall segment of FIG. 3.

FIG. 9 shows the wall segment 20 in greater detail. As mentioned earlier the first wall portion 20*a* is located adjacent to the periphery of the rotor 1 and thus adjacent to the periphery of the lower disc 4 (and at the periphery of the upper disc 2, which is not shown in FIG. 9) and is substantially tangential to its periphery. The second wall portion 20*b* has two sections. A first section 80 being a substantially straight plate starts at the rear support plate 42 and extends substantially perpendicularly therefrom towards the periphery of the rotor 1. The angle S between this first section 80 of the second wall portion 20*b* and the first wall portion 20*a* is 130°. At a perpendicular distance D from the first wall portion 20*a* the second wall portion 20*b* has a bend 82. The bend 82 divides the second wall portion 20*b* into the first section 80 and a straight second section 84, which, at an angle T of 90°, is welded to the first wall portion 20*a* at one end thereof. The length of the second section 84 thus equals the distance D from the bend 82 to the first wall portion 20*a*. A tip distance E is defined as the shortest distance from the second section 84 to a trailing edge 37 of the wear tip 36. The trailing edge 37 is the rear portion of the wear tip 36 as seen in the direction of the passage of a piece of rock (see the dashed arrow A in FIG. 10). The length D of the second section 84 is about 37% of the tip distance E. The second section 84 and that part 86 of the first wall portion 20*a* which is located adjacent to said second section 84 together form a pocket 88.

Figure 10:
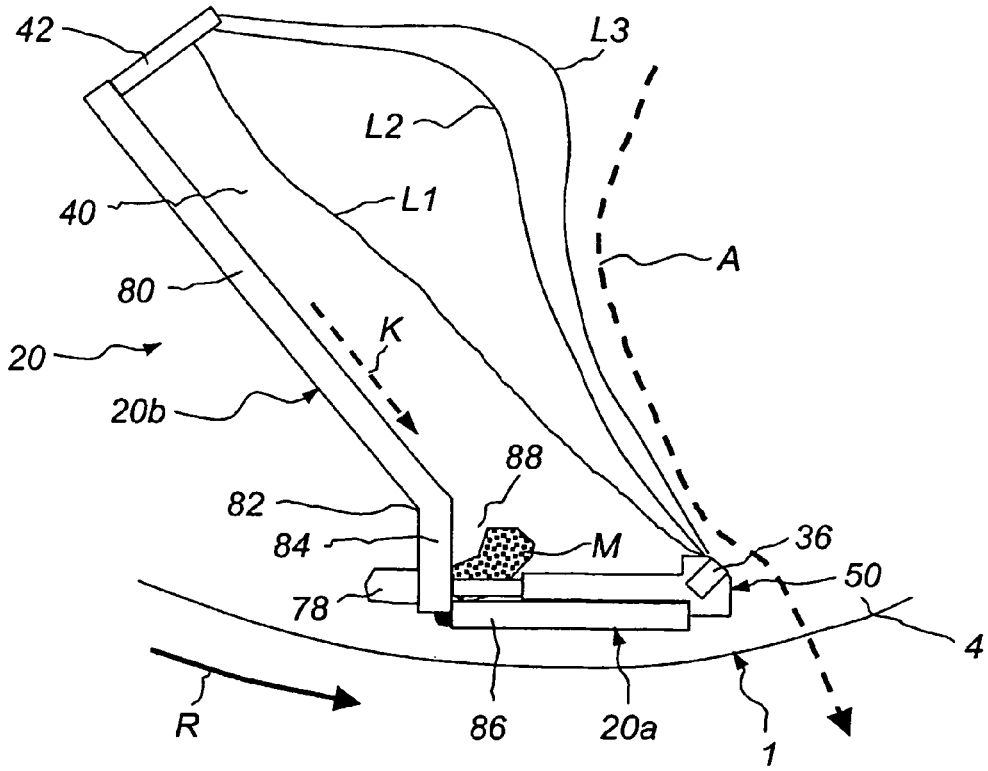
FIG. 10 is a top view and shows a bed of material built up against the wall segment shown in FIG. 9.

FIG. 10 shows the function of the pocket 88 during operation. As noted earlier a bed 40 of material will build up against the wall segment 20 during operation of the rotor 1. The pocket 88 will capture material during start of crusher operation and build up a stable bed 40 extending continuously from the first wall portion 20*a* to the rear support plate 42. The direction of rotation R of the rotor 1 will cause a centrifugal force that pushes captured pieces of material, schematically represented by a piece M in FIG. 10, into the pocket 88 and secures them there. The profile of the bed 40 of material will fluctuate due to slight differences in size and composition of feed material, slight variations in feed amount etc. The pieces M secured in the pocket 88 will, however, stabilise a stationary material profile L1 and ensure a good protection of the wall segment 20 against wear and of the tip holder 50 and the wear tip 36 against wear and impact of large objects. The varying material profile of the bed 40 during operation, indicated by the line L1 indicating the stationary (or minimum) material bed, line L2 indicating an average material profile, and line L3 indicating a maximum sized material bed, does not influence the protective function of the bed 40. The thick minimum material profile L1 assist in building a thick average material profile L2 which further improves the wear resistance characteristics of the bed 40 of material. The exact appearance of the passage of a rock piece, indicated by the dashed arrow A, will vary somewhat depending on the actual profile of the bed 40. During operation a force, indicated with an arrow K in FIG. 10, will tend to push the bed 40 outwardly from the rotor 1 due to a component of the centrifugal force generated by the rotor 1. The pieces of material M secured in the pocket 88 will however prevent the bed 40 from leaving the rotor 1 thus ensuring a stable bed 40 and little wear.

Figure 11:
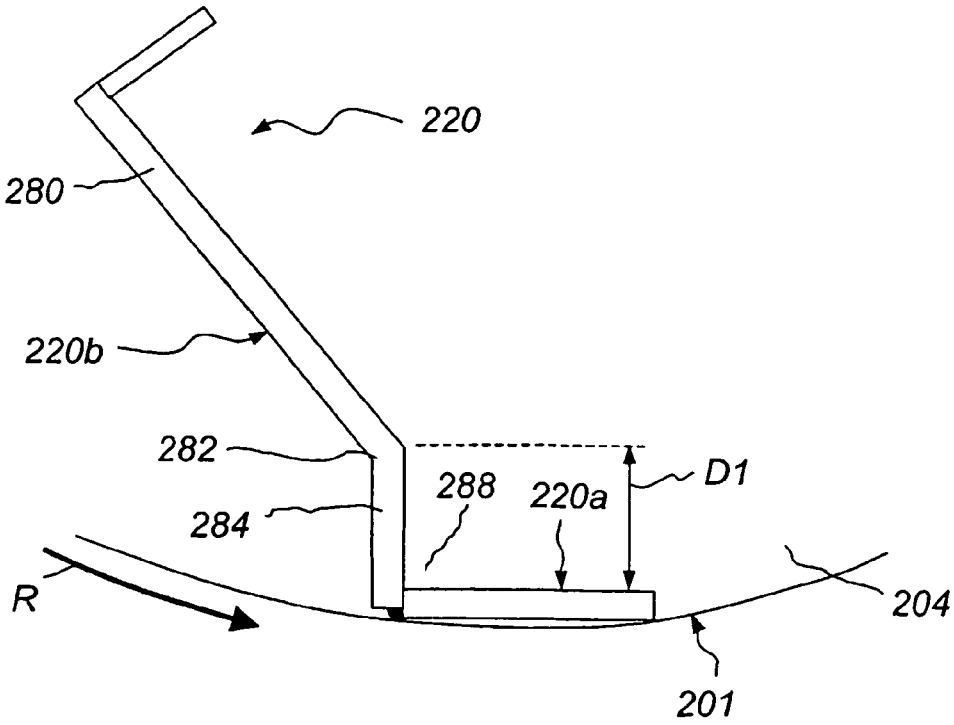
FIG. 11 is a top view and shows a second embodiment of the invention.

FIG. 11 shows a second embodiment in the form of a rotor 201. The rotor 201 has a wall segment 220 and a lower disc 204 (and a not shown upper disc). The wall segment 220 differs from that described in FIG. 9 and 10 in that a first wall portion 220*a*, and thus the tip holder and the wear tip (not shown in FIG. 11), is located closer to the periphery of the rotor 201. Thus the right-angled distance D1 from the first wall portion 220*a* to a bend 282, which divides a second wall portion 220*b* into a first section 280 and a second section 284, is larger compared to the distance D shown in FIG. 9. With a tip holder of the type described above mounted on the first wall portion 220*a* D1 would be about 50% of the actual tip distance. Thus a pocket 288 having the possibility of retaining very large pieces of material is created.

Figure 12:
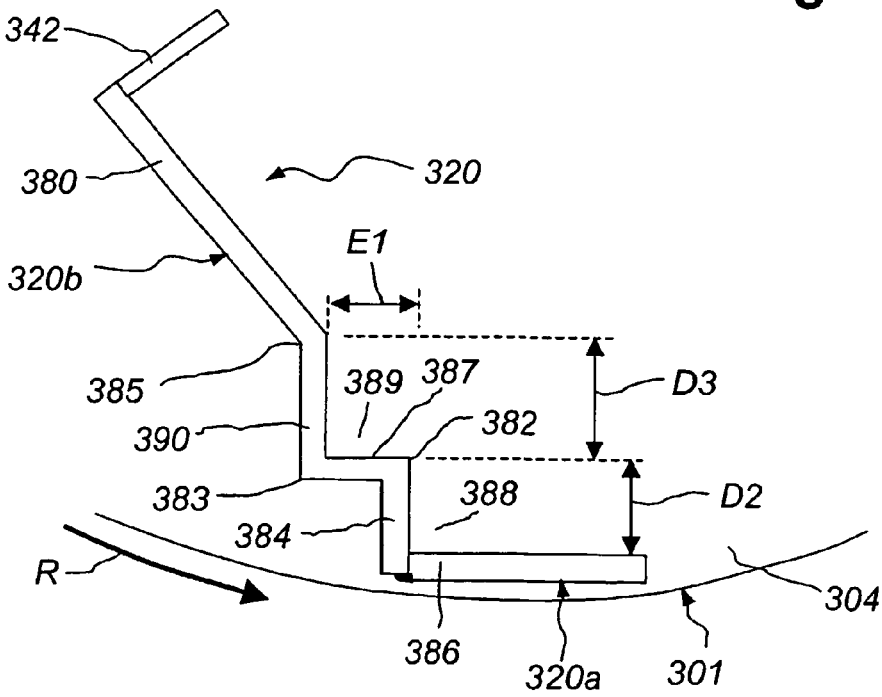
FIG. 12 is a top view and shows a third embodiment of the invention.

FIG. 12 shows a third embodiment in the form of a rotor 301. The rotor 301 comprises a wall segment 320 and a lower disc 304 (and a not shown upper disc). A second wall portion 320*b* of the wall segment 320 has a first section 380 being a substantially straight plate that starts at a rear support plate 342 and extends substantially perpendicularly therefrom towards the periphery of the rotor 301. The angle between this first section 380 of the second wall portion 320*b* and a first wall portion 320*a* is 130°. A second section 384 of the second wall portion 320*b* is welded to the first wall portion 320*a* and forms a right angle with the first wall portion 320*a*. The second section 384 and that part 386 of the first wall portion 320*a* which is located adjacent to said second section 384 together form a first pocket 388 for retaining pieces of material. The length D2 of the second section 384 is about 37% of the tip distance E as defined in FIG. 9. At the end of the second section 384 and thus at a perpendicular distance D2 from the first wall portion 320*a* the second wall portion 320*b* has a first right-angled bend 382. The bend 382 provides a shoulder section 387 being parallel to the first wall portion 320*a* and located a distance D2 therefrom. The length E1 of the shoulder section 387 is about 27% of the above mentioned tip distance. In general E1 should be 20-70% of the tip distance E. At the end of the shoulder section 387 a second right angled bend 383 is formed thereby providing a third section 390. The third section 390 forms a right angle to the first wall portion 320*a* and has a length D3 which is about 37% of the tip distance. In general D3 should be 20-70% of the tip distance E. The third section 390 and the shoulder section 387 together form a second pocket 389 for retaining pieces of material. A third bend 385 of the second wall portion 320*b* forms the transition from the third section 390 to the first section 380. The two pockets 388 and 389 provides for an improved capacity for retaining material and also decreases the tendency of material to flow outwardly of the rotor (compare the arrow K of FIG. 10). Thus the arrangement of FIG. 12 provides for building a very stable bed of material against the wall segment 320. Arrangements with three or more pockets are also possible. In such a case the dimensions of each subsequent pocket are preferably set in accordance with the ranges given above for D3 and E1. It should be noted that the tip distance E is always based on the distance to the second section and not the distance to any third or fourth section.

EXAMPLE

A test was made with a rotor having wall segments 20, 22, 24 according to the embodiment described in FIG. 9. The rotor had a diameter of 850 mm and was installed in a vertical shaft impact crusher. The rotor was rotated at 1500 rpm. During the first minute of operation a first material having a characteristic size of about 10 mm was fed to the rotor. Then a second material having a characteristic size of about 40 mm was fed to the rotor for about 40 hours until 9500 tons of material had been crushed. The crusher was then stopped and the bed 40 of material built up against the wall segment 20 was investigated. It was found that the bed 40 had an outer layer comprising material originating from the second material (the 40 mm material). Under the outer layer a stable bed of material (compare line L1 in FIG. 10) originating from the first material (the 10 mm material) was found. The fact that the stable bed of material originated from the first material (the 10 mm material) shows that the rotor according to the invention was able to very quickly (in less than one minute) build up a protective bed 40 of material against the wall segment and also to keep that bed 40 of material stable and secured during continuous operation of the crusher.

It will be appreciated that numerous modifications of the embodiments described above are possible within the scope of the appended claims.

Thus the pockets for retaining material may have other depths and other angles T between the second section and the first wall portion. However, as described above, an angle T of about 90° has proven to give a very stable bed and the ability to retain also large objects.

The angle S between the first section 80 of the second wall portion 20*b* and the first wall portion 20*a* is preferably 110-155°. It has however been found that an angle S of 120° and larger provide a more even bed profile and a more stable bed. The extra bed weight resulting from an angle of over 150° is seldom motivated by a further increase in bed stability. The angle S is thus more preferably in the range of 120-150°.

The length D, D1, D2 of the second section 84, 284 and 384 respectively is preferably 20-70% of the tip distance E. A length D, D1, D2 of the second section 84, 284, 384, respectively, of 35-60% of the tip distance E has been found to provide a particularly good balance between the desire to capture large objects in the pocket and the desire to obtain a thick and continuous bed 40 of material, said bed 40 having a sufficient thickness also adjacent to the bend 82, 282, 382. Preferably the stationary bed 40 of material (compare line L1 in FIG. 10) has a substantially even thickness along the first section 80.

The second wall portion 20*b* comprising at least two sections 80, 84 could be made from one bent metal sheet or could be made from separate pieces welded together. It is preferable to make the second wall portion 20*b* from one sheet of metal since this reduces the risk of breakdown and decreases the manufacturing costs.

The invention claimed is:

1. A rotor for a vertical shaft impact crusher, said rotor comprising a horizontal upper disc and a horizontal lower disc, said discs being separated by at least two vertical wall segments defining between them an outflow opening for material leaving the rotor, said wall segments each having a first wall portion being substantially tangential in relation to the rotor and being located adjacent to the periphery of the rotor and a second wall portion being angled in relation to said first wall portion and extending from the first wall portion into the rotor, wherein said second wall portion comprises a straight first section extending from the interior of the rotor towards the periphery of the rotor, said first section forming an obtuse first interior angle with said first wall portion, and a second section connecting the first section and the first wall portion, said second section and said first wall portion forming a second interior angle being smaller than said first interior angle, said second section and said first wall portion forming at least one pocket for retaining material, wherein an end of the second section contacts an end of the first wall portion and the second section is oriented in a radial direction relative to an axis of rotation of the rotor.

2. A rotor according to claim 1, wherein said first angle is approximately 110-155°.

3. A rotor according to claim 2, wherein said first angle is approximately 120-150°.

4. A rotor according to claim 2, wherein said second angle is approximately 75-100°.

5. A rotor according to claim 4, wherein said second angle is approximately 86-94°.

6. A rotor according to claim 1, wherein a second pocket for retaining material is formed between said first section and said second section.

7. A rotor according to claim 1, wherein the first section is in spaced relation from the first wall portion with the second section therebetween.

8. A rotor according to claim 1, wherein two pockets for retaining material are formed between said first section and said first wall portion.

9. A rotor for a vertical shaft impact crusher, said rotor comprising a horizontal upper disc and a horizontal lower disc, said discs being separated by at least two vertical wall segments defining between them an outflow opening for material leaving the rotor, said wall segments each having a first wall portion being substantially tangential in relation to the rotor and being located adjacent to the periphery of the rotor and a second wall portion being angled in relation to said first wall portion and extending from the first wall portion into the rotor, wherein said second wall portion comprises a straight first section extending from the interior of the rotor towards the periphery of the rotor, said first section forming an obtuse first angle with said first wall portion, and a second section connecting the first section and the first wall portion, said second section and said first wall portion forming a second angle being smaller than said first angle, said second section and said first wall portion forming at least one pocket for retaining material, wherein a horizontal length of the second section is less than a tip distance, wherein the tip distance is defined as the shortest distance between the second section and a trailing edge of a wear tip located adjacent to a free vertical edge of the first wall portion.

10. A rotor according to claim 9, wherein said horizontal length is 20-70% of the tip distance.

11. A rotor according to claim 10, wherein said horizontal length is 35-60% of the tip distance.

12. A rotor for a vertical shaft impact crusher, said rotor comprising a horizontal upper disc and a horizontal lower disc, said discs being separated by at least two vertical wall segments defining between them an outflow opening for material leaving the rotor, said wall segments each having a first wall portion being substantially tangential in relation to the rotor and being located adjacent to the periphery of the rotor and a second wall portion being angled in relation to said first wall portion and extending from the first wall portion into the rotor, wherein said second wall portion comprises a straight first section extending from the interior of the rotor towards the periphery of the rotor, said first section forming an obtuse first angle with said first wall portion, and a second section connecting the first section and the first wall portion, said second section and said first wall portion forming a second angle being smaller than said first angle, said second section and said first wall portion forming at least one pocket for retaining material, wherein the wall segment is adapted for building a bed of material extending continuously from the first wall portion to a rear support plate mounted at the first section of the second wall portion.

* * * * *